US009259062B2

(12) United States Patent
Martinez

(10) Patent No.: US 9,259,062 B2
(45) Date of Patent: Feb. 16, 2016

(54) TACTICAL FINGER BAND

(71) Applicant: Jesus Martinez, Perth Amboy, NJ (US)

(72) Inventor: Jesus Martinez, Perth Amboy, NJ (US)

( * ) Notice: Subject to any disclaimer, the term of this patent is extended or adjusted under 35 U.S.C. 154(b) by 0 days.

(21) Appl. No.: 14/035,102

(22) Filed: Sep. 24, 2013

(65) Prior Publication Data

US 2014/0083135 A1 Mar. 27, 2014

Related U.S. Application Data

(60) Provisional application No. 61/704,591, filed on Sep. 24, 2012.

(51) Int. Cl.
*A44C 9/00* (2006.01)

(52) U.S. Cl.
CPC ..... *A44C 9/0092* (2013.01); *A44C 9/0038* (2013.01)

(58) Field of Classification Search
CPC ..... A44C 9/0092; A44C 9/0038; A44C 9/02; A44C 9/0084; A44C 9/0053; G04B 37/005; A41D 13/08; A41D 13/087
USPC ..... 63/15.8, 15.1, 15.6, 40, 15, 15.2–15.4, 63/15.7, 15.9, 11, 33, 1.18; D11/26, 86; 368/282, 283, 281; 206/6.1; 224/170, 224/171; 2/21
See application file for complete search history.

(56) References Cited

U.S. PATENT DOCUMENTS

| | | | | |
|---|---|---|---|---|
| 856,282 A | | 6/1907 | Moss | |
| 1,121,296 A | | 12/1914 | Schmidt | |
| 1,533,441 A | | 4/1925 | Melling | |
| 1,885,930 A | | 11/1932 | Lowy | |
| 2,048,317 A | * | 7/1936 | Berman | 63/15.8 |
| 2,076,221 A | * | 4/1937 | Bradbury | 368/281 |
| 2,665,042 A | | 1/1954 | Starolis | |
| 3,263,444 A | * | 8/1966 | Di Croce | 63/15.7 |
| 3,465,543 A | | 9/1969 | Baker | |

(Continued)

FOREIGN PATENT DOCUMENTS

| | | |
|---|---|---|
| GB | 2362310 A | 11/2001 |
| GB | 2373431 A | 9/2002 |

(Continued)

OTHER PUBLICATIONS

International Search Report and Written Opinion; PCTUS2013/061383; Jan. 30, 2014; 7 pages.

(Continued)

*Primary Examiner* — Abigail Morrell
(74) *Attorney, Agent, or Firm* — Gearhart Law, LLC

(57) ABSTRACT

A tactical finger band is described and taught having a band body which has one segment or is longitudinally dividable into multiple segments. The band body is openable due to the use of one or more socket-protrusion assembly as connecting mechanisms. In addition, the tactical finger band may also include a band cover or other accessories. The tactical finger band disclosed here is particularly suitable for people engaging in industrial work, medical careers, sports activities, military missions, and law enforcement and fire-fighting operations. With a sufficient pulling force applied to the band body, the finger band may be opened due to the disengagement of the socket-protrusion assembly, preventing injury to the wearer. Moreover, the band body and/or the band cover may bear patterns, colors, logos, and words appropriate for the occasion in which the band is used and the person wearing the band.

8 Claims, 2 Drawing Sheets

(56) References Cited

U.S. PATENT DOCUMENTS

| | | | | |
|---|---|---|---|---|
| 3,465,544 | A | 9/1969 | Tucker | |
| 3,557,571 | A * | 1/1971 | De Santo | 63/15.6 |
| 3,566,616 | A * | 3/1971 | Benedict, Jr. | 63/15.7 |
| 3,619,913 | A * | 11/1971 | Albrecht | 434/386 |
| 4,845,777 | A | 7/1989 | Mersinas | |
| 4,991,409 | A | 2/1991 | Creates | |
| 5,136,858 | A | 8/1992 | Bruner | |
| 5,433,090 | A | 7/1995 | Santiago | |
| 5,517,692 | A | 5/1996 | Wunderlich-Kehm | |
| 6,032,485 | A | 3/2000 | Steinberg | |
| 6,370,914 | B1 | 4/2002 | Bruner | |
| 6,481,244 | B1 * | 11/2002 | Wright | 63/15.8 |
| 6,701,746 | B1 | 3/2004 | Bentley | |
| 6,840,894 | B2 | 1/2005 | Lerner | |
| 7,107,789 | B1 | 9/2006 | Bruner | |
| 7,347,066 | B1 | 3/2008 | Feuer | |
| 7,523,556 | B2 | 4/2009 | Tye | |
| 7,654,111 | B2 | 2/2010 | Alley et al. | |
| 2008/0148776 | A1 | 6/2008 | Alley et al. | |
| 2008/0184738 | A1 | 8/2008 | Smarsh | |
| 2012/0118016 | A1 * | 5/2012 | Maloney et al. | 63/15.8 |

FOREIGN PATENT DOCUMENTS

| | | | |
|---|---|---|---|
| GB | 2377877 | A | 1/2003 |
| SU | 1809890 | A3 | 6/1907 |
| SU | 188758 | A | 11/1966 |
| WO | WO2010/102333 | A4 | 9/2010 |

OTHER PUBLICATIONS

International Preliminary Report on Patentability; PCTUS2013/061383; Apr. 2, 2015; 11 pages.

* cited by examiner

TACTICAL FINGER BAND

CLAIM OF PRIORITY

This application is a utility application claiming priority to U.S. Application Ser. No. 61/704,591 filed on Sep. 24, 2012 entitled "Tactical Finger Band," which is herein incorporated by reference in its entirety.

FIELD OF THE INVENTION

The current invention relates to finger bands. In particular, the current invention relates to tactical finger bands that are openable, easily disguised, and suitable for preventing injury to the wearers of the bands.

BACKGROUND OF THE INVENTION

Wearing finger bands, such as rings, has been a common practice by a great number of people. Nowadays, both men and women wear engagement rings, wedding rings, anniversary bands, and other bands and rings that serve aesthetic, ceremonial, and commemorating purposes. Such jewelry and accessories have become an indispensable part of many people's lives, serving as symbols for love and commitment.

However, wearing rings or bands on the fingers may become problematic in certain occasions. For example, in an industrial setting where there are many articulating structures such as crooks, claws, and hamuli, there is an enhanced possibility of injury if the tactical finger band is caught by any of the articulating parts. In addition, the problem becomes even more acute when the wearer is on a military mission or in a police operation, the finger bands may be caught up by protruding structures such as tree branches, fences ledges, or firearm parts. Such accidents may prove to be dangerous, even deadly, to the wearers of the finger bands.

In the military and law enforcement settings, wearing a finger band may cause another problem. In particular, since most of the bands are made from shiny materials such as gold and platinum, it is a strategic disadvantage to wear the bands because a reflection or deflection of light may expose the location of the wearer. This problem, similar to the possibility of injury indicated above, arises very frequently though the likelihood of actual occurrence for exposure and injury is relatively small.

One seemingly simple solution for all these problems is to take the bands off before any work engagement, military mission, or police or firefighting operation. However, such an approach is problematic because (1) many people are hesitant to take their bands off because the bands are symbols of love and commitment, (2) taking the bands off, especially frequently, may results in loss or damages, and (3) it is easy to forget to take the band off. Another approach, which is widely practiced in the military, is to cover the band with black electrical tapes before operations. However, this approach is likely to leave a great deal of tape residues on the bands, making the bands ugly and hard to clean.

The current invention addresses all these issues in a simple but comprehensive manner.

DESCRIPTION OF RELATED ART

U.S. Pat. No. 4,991,409 discloses a finger ring made of two arcute segments hinged together at one end of the segments are adapted to be locked with a clasp at the other end. The clasp is hingedly mounted on one segment and adapted to hook onto a transversal rod fixed on the other segment. A circumferential leaf spring fixed on the one segment adjacent the clasp, resiliently maintains the clasp in a position projecting at the free end of the one segment. Another similar leaf spring is positioned at the hinged end of the segments for resiliently maintaining the latter in a substantially circular relationship and firms up the action to snap open and snap shut the segments.

U.K Patent GB2373431 discloses a protective cover for an item of jewellery such as a finger ring comprises either a strip of material with complementary contact fastening means at opposite ends thereof, or a preformed elastic cylinder. The fastening means may comprise hook and loop material or a press-stud. The cover may be impregnated with a deodorant or a disinfectant.

These inventions, however, are not designed to address the problems indicated above. The openable ring of U.S. Pat. No. 4,991,409 is aimed at making the ring easier to put on and take off, not protecting the wearer from injury. The ring cover of GB2373431 is used to protect the ring from external damages. The current invention is different from these disclosures.

In summary, various designs are known in the art, but their structures are distinctively different from the current invention. Moreover, the other inventions fail to address all of the problems solved by the invention described herein. One embodiment of this invention is illustrated in the accompanying drawings and will be described in more detail herein below.

SUMMARY OF THE INVENTION

The current invention discloses a tactical finger band to surround a finger, comprising: an encircling band body which has only one segment or is longitudinally dividable into multiple segments. The band body has an inner side and an outer side, wherein the band body is capable of encircling the finger, the inner side faces the finger and the outer side faces away from the finger. If the band body is a single segment, then the band body may have a first end and a second end, making the band body a circle, wherein the first end and the second end are connected by a socket-protrusion assembly. Similarly, if the band body is longitudinally dividable into multiple segments, the segments may also be connected by a number of socket-protrusion assemblies, wherein the segments are connected one by one so that the band body is a circle.

The socket-protrusion assembly is a connecting structure that may be used to assemble the tactical finger band. Taking the single segment band body design as an example, the socket-protrusion assembly may comprise a protruding element linked to the first end, the protruding element having a protrusion neck and an enlarged head; and a socket in the second end, the socket having an enlarged void and a narrow passage, the enlarged void and the narrow passage being surrounded by two clamping elements, wherein the protruding element is capable of being inserted into the socket, the enlarged head fits the enlarged void, the protrusion neck fits the narrow passage, the insertion of the protruding element into the socket securely attaches the first end to the second end.

The essential goal of utilizing the socket-protrusion assembly is to allow the tactical finger band to be openable. With a sufficient pulling force on the band body, the clamping elements around the socket may be deformed so that the protruding element is released from the socket, disengaging the band body from a circular form and allowing the finger to escape the embrace of the band, preventing injury to the wearer.

Here, the term "finger band" is broadly defined. It may refer to any types of bands, rings, jewellery, or ornament worn on fingers or toes. The current invention may also cover band or ornaments worn or around the arm, neck, or other body parts. As long as a subject utilizes the anti-injury concept of the current invention, it is with the purview of the current invention.

The tactical finger band may further comprise a band cover shielding the outer side of the band body. The band cover may comprise a band cover exterior portion, a band cover inner fold connected to the band cover exterior portion, wherein there is a band cover opening on the band cover inner fold, wherein the band body is capable of being inserted into the band cover through the band cover opening, the band cover exterior portion shields the outer side of the band body, and the band cover inner fold embraces the inner side of the band body, securing the band body in a band cover chamber. To allow easy insertion of the band body, the band cover is preferably made from elastic materials such as soft composite. Since the band cover is elastic, it does not affect the openable feature of the band body. When the tactical finger band gets caught in a protruding structure, the socket-protrusion assemblies disengage and the band body opens, stretching the band cover and releasing the finger, preventing injury to the wearer.

The band cover, which is an optional accessory, provides a shielding mechanism to the tactical finger band. As indicated above, it is desirable, in many occasions such as a military operation, to shield a shining finger band so that it does not expose the wearer's position. Therefore, the band cover is preferably made from non-reflective materials and the color of the band cover is preferred to be not too bright. The band cover may also bear patterns, colors, logos, and pictures that may provide a camouflage effect. For example, a band cover designed for army soldiers may have on its exterior a US army woodland camouflage pattern or US Army ACU design.

Since the band cover is an optional structure, the band body may share the same features and preferences described above for the band cover. For example, the outer side of the band body may have a camouflage pattern. On the other hand, since the band body may be shielded, there is no preference that the band body be made from non-shining materials with darker colors. Just as with the other bands and rings, the tactical finger band may serve aesthetic, ceremonial, and commemorating purposes and may bear any color, pattern, logo, and words that are appropriate.

In addition to the features described above, the tactical finger band may include other structures that enhance the band's capacity to be used in intense and confrontational environments. For example, the tactical finger band may include a plurality of beads attached to the inner side of the band body, wherein the beads prevent slipping between the finger and the band body. Such a design reduces the chance that the finger ring is lost, for instance, when the wearer takes on an underwater mission.

In general, the present invention succeeds in conferring the following, and others not mentioned, desirable and useful benefits and objectives.

It is an object of the present invention to provide a tactical finger band that may reduce the chances of injury to the wearer.

It is an object of the present invention to provide a tactical finger band that has a band body encircling a finger of the wearer.

It is an object of the present invention to provide a tactical finger band that has a band body with one more segments.

It is an object of the present invention to provide a tactical finger band that has a band body using socket-protrusion assemblies as connecting mechanisms.

It is another object of the current invention to provide a tactical finger band that is openable when a sufficient pulling force is applied to the band body.

It is another object of the current invention to provide a tactical finger band that is easy to put on and easy to take off.

It is still another object of the current invention to provide a tactical finger band that is suitable to wear during military missions, law enforcement and fire-fighting operations.

It is still another object of the current invention to provide a tactical finger band that is suitable to medical response operations.

It is another object of the current invention to provide a tactical finger band that is suitable to wear during hiking trips and sports activities.

It is yet another object of the current invention to provide a tactical finger band that includes a band cover that shields the band body.

It is another object of the current invention to provide a tactical finger band that includes a band cover made from elastic materials.

It is yet another object of the current invention to provide a tactical finger band that has a band body bearing patterns, colors, logos, and words.

It is another object of the current invention to provide a tactical finger band that includes a band cover bearing patterns, colors, logos, and words.

It is yet another object of the current invention to provide a tactical finger band that has a band body bearing patterns, colors, logos, and words providing camouflage effects.

It is another object of the current invention to provide a tactical finger band that includes a band cover bearing patterns, colors, logos, and words providing camouflage effects.

It is another object of the current invention to provide a tactical finger band that includes mechanisms preventing inadvertently losing the finger band.

It is yet another object of the current invention to provide a tactical finger band that is easy to use and easy to manufacture.

DESCRIPTION OF THE PREFERRED EMBODIMENTS

Figure 1:
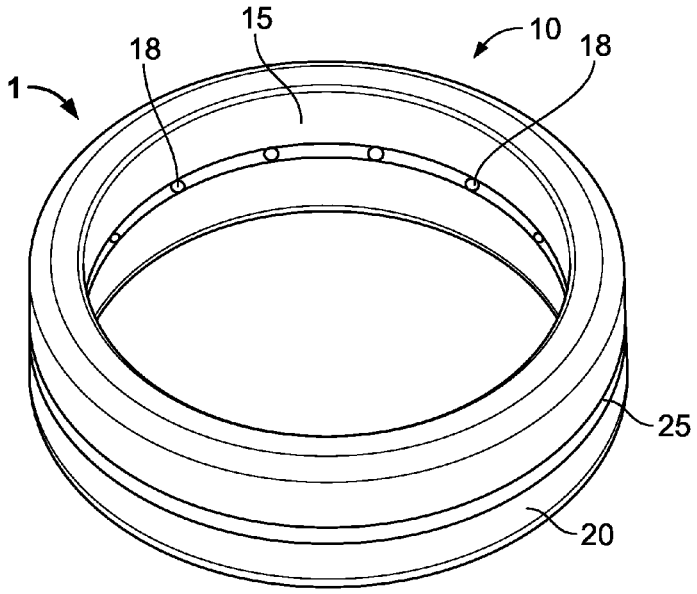
FIG. 1 shows a top perspective view of a tactical finger band.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

FIG. 1 shows a top perspective view of a tactical finger band 1. Shown in FIG. 1 is the tactical finger band 1 having a band body 10, the band body 10 having a inner side 15 and an outer side 20. Attached to the inner side 15 of the band body 10 are anti-slipping beads 18. The tactical finger band 1 is suitable for providing an encirclement around a person's finger or other body parts. As indicated above, the term "band" is broadly defined. A top view of the band may be a round, oval, or any other shape that may form an encirclement. Preferably, the tactical finger band 1 is worn by a person on one of his/her fingers. When it is worn, the inner side 15 faces the finger and the outer side 20 faces away from the finger.

The band body 10 may be made from any material including but are not limited to: metals such as gold, silver, platinum, titanium, and alloy, glass or fiberglass, rubber, composite materials, and plastic such as, but not limited to, polyethylene terephthalate (PET), high-density polyethylene, polyvinyl chloride (PVC), polyvinylidene chloride (PVDC), polystyrene (PS), high impact polystyrene (HIPS) and polycarbonate (PC), or some combination thereof. It is preferred that the band body material is durable and resilient. The preferred material is composite, especially soft composite.

The anti-slipping beads 18 are attached to the inner side 15 of the band body 10. As shown in FIG. 1, these beads may attach to a middle circle in the inner side 15. Alternatively, the anti-slipping beads 18 may attach to any part of the inner side 15 and the number of the anti-slipping beads 18 may vary according to the needs of the user. Preferably, the anti-slipping beads 18 are evenly distributed for even friction. These beads are optional structures for the tactical finger band 1 and they are designed to added friction between the band body 10 and the finger, preventing the wear from inadvertently losing the tactical finger band 1. Consequently, these beads are particularly useful for wearer conducting underwater missions or other operations involving liquid. The anti-slipping beads 18 may be made from the same or different materials as the band body 10 and they may be made from the materials listed above for the band body 10, with the preferred materials being glass or fiberglass.

As indicated above, the band body 10 may be marked and decorated according to the type of the finger band and the needs of the wearer. Moreover, the band body 10, especially the outer side 20, may bear colors, patterns, logos, and texts that serve as symbols profession, emotion, and commemoration. For example, as shown in FIG. 1, the center strip 25 on the outer side 20 may be colored blue to indicate that the wearer is a police officer. Moreover, as indicated above, the band body 10 may bear patterns, colors, logos, and texts that may have camouflaging effects, assuring that the wearer in a dangerous operation does not get exposed due to the reflective surface of the finger band.

Figure 2A:
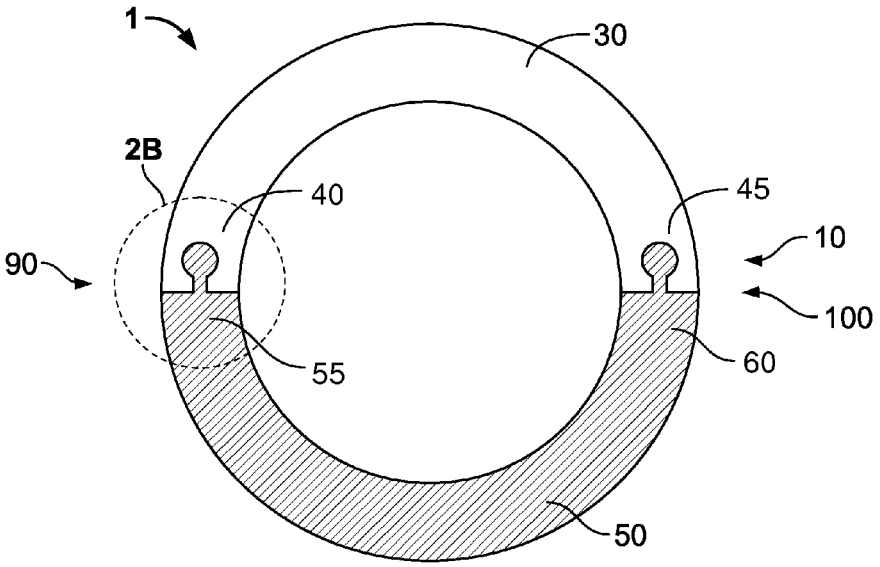
FIG. 2A shows top sectional view of a tactical finger band.

FIG. 2A shows a top sectional view of a tactical finger band. Shown in FIG. 2A is the tactical finger band 1 having a band body 10. The band body 10 has a first segment 30 and a second segment 50. As shown in FIG. 2A, the first segment 30 has a first segment first end 40 and a first segment second end 45. The second segment 50 has a second segment first end 55 and a second segment second end 60. The first segment first end 40 connects to the second segment first end 55 with a first socket-protrusion assembly 90 and the first segment second end 45 connects to the second segment second end 60 with a second socket-protrusion assembly 100. The first socket-protrusion assembly 90 and the second socket-protrusion assembly 100 have a similar structure, the details of which are shown in FIG. 2B.

Figure 2B:
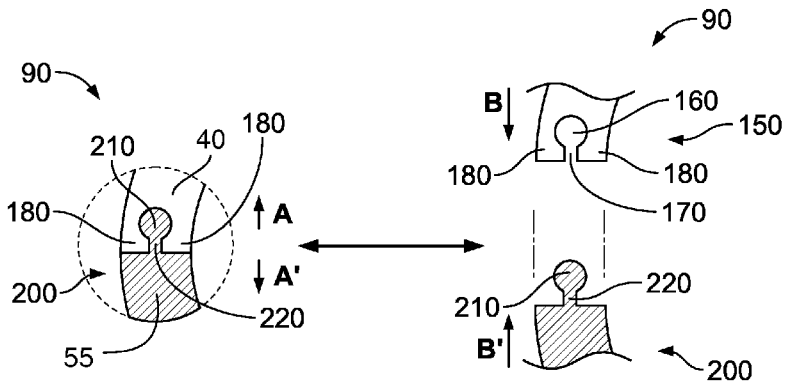
FIG. 2B shows top sectional view of a socket-protrusion assembly.

FIG. 2B shows a top sectional view of a socket-protrusion assembly, in its both connected and disconnected forms, illustrating the details of the socket-protrusion assembly. As indicated above, the first socket-protrusion assembly 90 and the second socket-protrusion assembly have similar structures and the first socket-protrusion assembly 90 is shown in FIG. 2B as an example.

FIG. 2B illustrates the details of the first socket-protrusion assembly 90, which is encircled with dotted lines in FIG. 2A. Here shown in FIG. 2B is a protruding element 200 on the second segment first end 55, the protruding element 200 having an enlarged head 210 and a protrusion neck 220, the protruding element 200 is connected to the first segment first end 40 through a socket 150, the socket 150 having an enlarged void and a narrow passage 170.

As shown in FIG. 2B, in a connected state, the protruding element 200 fits into the socket 150. In particular, the enlarged head 210 is positioned in the enlarged void 160 and the protrusion neck 220 fits the narrow passage 170. With a sufficient tearing force applied to the band body 10, the protruding element 200 and the socket 150 move in directions as shown by arrows A and A'. The clamping elements 180 are bent to the side, allowing the enlarged head 210 to pass and disengaging the first segment first end 40 and the second segment first end 55, allowing the first segment 30 and the second segment 50 to disengage. Similarly, in a disconnected state, the first segment 30 and the second segment 50 may become engaged by moving the first segment first end 40 and the second segment first end 55 in the directions shown as B and B'. The clamping elements 180 flex to the side, allowing the protruding element 200 to be inserted into the socket 150.

As indicated above, the first socket-protrusion assembly 90 is only shown in FIG. 2B as an example. It is possible that the protruding element 200 and the socket 150 are located in different ends as shown in FIG. 2B. For example, the protruding element 200 may be connected to the first segment first end 40 and the socket 150 is on the second segment first end 55. It is also possible that the first segment 30 has one protruding element on one end and a socket 150 on another, while the second segment 50 has corresponding structures. Moreover, it is also possible that the band body 10 has one segment or three of more segments, instead of two. For example, when the band body 10 has only one segment, the segment may have a protruding element 200 on one end and a socket 150 on other, allowing the protruding element 200 and the socket 150 to engage so that the single segment may form an encircling structure. As long as the protruding elements are in position to engage sockets so that the segment or segments form the band body 10 that may be disassembled so that the finger engaged by the band body 10 may be releases, the structure is within the coverage of the current invention.

The socket-protrusion assembly is designed to disengage under sufficient tearing forces and the threshold force may vary from 0.1 to 10,000 Newtons (0.0225 to 2248 pounds), with the preferred threshold force to be between 1 and 500 Newtons (0.225 and 1124 pounds). The essential goal is to protect the wearer from injury. For a wearer having strong fingers, the threshold force, which is partially determined by the structures of the socket-protrusion assembly and the materials used, may be set higher. For a wearer having more fragile fingers, the threshold force may be set lower.

Although the top sectional view of the enlarged head 210 is largely round, it should be noted that other shapes are also possible depending on the specific design. For example, if the top sectional view of the enlarged head 210 is a square, the socket-protrusion assembly may become more difficult to assemble and disassemble. Moreover, the enlarged head 210 may be a rod (with the side sectional view of a rectangle) or a sphere (the side sectional view of round shape), among other possibilities. The precise structures of the socket-protrusion assembly may vary according to the needs of the wear and the missions/operations he/she may engage.

Figure 3A:
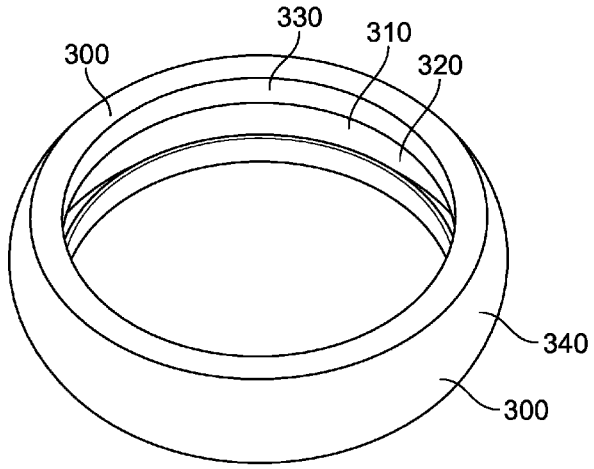
FIG. 3A shows a top perspective view of a band cover for a tactical finger band.

FIG. 3A shows a top perspective view of a band cover 300 for a tactical finger band 1. Shown in FIG. 3A is the band cover 300 having a band cover exterior portion 340, band cover inner folds 330, a band cover opening 310, and band cover chamber 320.

Figure 3B:
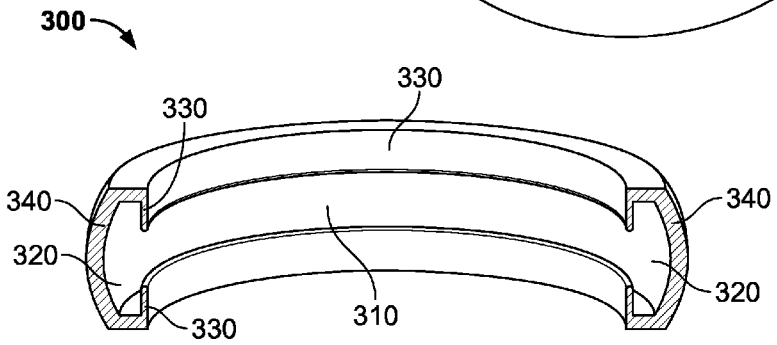
FIG. 3B shows a cut-away side perspective view of the band cover for a tactical finger band.

FIG. 3B shows a cut-away side perspective view of the band cover for a tactical finger band. Shown in FIG. 3B is the band cover 300 having a band cover exterior portion 340, band cover inner folds 330, a band cover opening 310, and band cover chamber 320.

As shown in FIGS. 3A and 3B, the band cover inners fold 330 flank the band cover opening 310 and the band cover inner fold 330 and the band cover exterior portion 340 define the band cover chamber 320. The tactical finger band 1 may be inserted through the band cover opening 310 into the band cover chamber 320. The band cover exterior portion 340 is held flush against the outer side 20 of the band body 10 and the band cover inner folds 330 is held against the inner side 15 of the band body 10.

The band cover 300 is preferably made from elastic materials including but not limited to soft rubber and deformable plastic. Since the band cover 300 is designed to be almost exactly the same size as the band body 10 when the band cover 300 is un-stretched, being made form elastic materials allows the band cover 300 to be stretched so that the band body 10 may be inserted. Since the band cover 300 is easy to put onto and take off from the band body 10, a wear of the tactical finger band 1 may have multiple band covers 300 to match the needs of the user and the occasion.

As indicated above, when the band cover 300 is designed to be used by persons likely to engage in military missions and law enforcement operations, it is preferred that the band cover 300, especially the band cover exterior portion 340, have colors that are not bright, such as dark blue, or dark green. It is also desirable that the band cover exterior portion 340 bears patterns, colors, logos, and words having camouflage effects.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A tactical finger band to surround a finger, comprising
an encircling band body having an inner side and an outer side, the band body being longitudinally dividable into a first segment and a second segment, wherein
the first segment has a first segment first end and a first segment second end,
the second segment has a second segment first end and a second segment second end,
the first segment first end is connected by a first socket-protrusion assembly to the second segment first end,
the first segment second end is connected by a second socket-protrusion assembly to the second segment second end,
the band body is capable of encircling the finger,
such that the inner side faces the finger and the outer side face away from the finger;
a plurality of beads attached to the inner side of the band body,
wherein the beads prevent slipping between the finger and the band body when the band body is worn on the finger; and
a circular band cover shielding the outer side of the band body having two band cover inner folds connected to a band cover exterior portion,
wherein there is a band cover opening flanked by the band cover inner folds,
wherein the band body is capable of being inserted into the circular band cover through the band cover opening, and
wherein the circular band cover completely envelops the outer side of the band body, and the band cover inner folds embrace the inner side of the band body.

2. The tactical finger band of claim 1, wherein the first socket-protrusion assembly comprises
a protruding element connected to the first segment first end,
the protruding element having a protrusion neck and an enlarged head;
and a socket in the second segment first end,
the socket having an enlarged void and a narrow passage,
the enlarged void and the narrow passage being surrounded by two clamping elements, wherein
the protruding element is capable of being inserted into the socket,
the enlarged head fits the enlarged void, the protrusion neck fits the narrow passage,
the insertion of the protruding element into the socket securely attaches the first segment first end to the second segment first end.

3. The tactical finger band of claim 2, wherein
the first socket-protrusion assembly and the second socket-protrusion assembly have the same structure.

4. The tactical finger band of claim 3, wherein
the clamping elements are capable of being deformed so that the protruding element is capable of being released from the socket with a sufficient pulling force on the first segment or the second segment.

5. The tactical finger band of claim 1, wherein the circular band cover comprises a non-reflective material.

6. The tactical finger band of claim 1, wherein
the circular band cover comprises elastic materials.

7. A tactical finger band to surround a finger, comprising
an encircling band body having an inner side, and an outer side, the band body being longitudinally dividable into a first segment and a second segment, wherein
the first segment has a first segment first end and a first segment second end,
the second segment has a second segment first end and a second segment second end,
the first segment first end is connected by a first socket-protrusion assembly to the second segment first end,
the first segment second end is connected by a second socket-protrusion assembly to the second segment second end,
the band body is capable of encircling the finger
such that the inner side faces the finger and the outer side faces away from the finger,
the socket-protrusion assemblies are capable of being disengaged with a sufficient pulling force on the first segment or the second segment, a plurality of beads attached to the inner side of the band body, wherein the beads prevent slipping between the finger and the band body when the band body is worn on the finger, a circular band cover shielding the outer side of the band body, the circular band cover comprising a band cover exterior portion, two band cover inner folds connected to the band cover exterior portion, wherein there is a band cover opening flanked by the band cover inner folds, wherein the band body is capable of being inserted into the circular band cover through the band cover opening, the circular band cover completely envelops the outer side of the band body, the band cover exterior portion shields the outer side of the band body, the band cover inner folds embrace the inner side of the band body, securing the band body in a band cover chamber, and the band cover is made from elastic materials.

8. The tactical finger band of claim 7 wherein the elastic materials are non-reflective.

* * * * *